US005863095A

United States Patent [19]

Rivard et al.

[11] Patent Number: 5,863,095

[45] Date of Patent: Jan. 26, 1999

[54] LOBED LUMBAR PILLOW

[76] Inventors: John Michael Rivard, 1014 Coral Ave., Tampa, Fla. 33602; Wendy R. Graham, 4921 Riding Ridge Rd., Greensboro, N.C. 27410

[21] Appl. No.: 995,426

[22] Filed: Jan. 13, 1998

[51] Int. Cl.[6] ..... A47C 7/02

[52] U.S. Cl. ..... 297/230.13; 297/284.5

[58] Field of Search ..... 297/284.5, 397, 297/391, 452.3, 452.34, 284.1, 284.4, 284.6, 398, 220, 228.12, 219.1, 230.13, 230.14, 230.1, 352, 452.41; 5/653, 654

[56] References Cited

U.S. PATENT DOCUMENTS

| | | |
|---|---|---|
| 3,061,844 | 11/1962 | Coursey . |
| 3,156,500 | 11/1964 | Kerr . |
| 4,189,182 | 2/1980 | Rhoe . |
| 5,314,235 | 5/1994 | Johnson . |
| 5,344,211 | 9/1994 | Adat et al. . |
| 5,475,882 | 12/1995 | Sereboff . |
| 5,711,575 | 1/1998 | Hand et al. . |

FOREIGN PATENT DOCUMENTS

| | | |
|---|---|---|
| 1319714 | 1/1963 | France . |
| 1472245 | 1/1967 | France . |
| 3418253 | 11/1985 | Germany . |
| 385441 | 12/1932 | United Kingdom . |

*Primary Examiner*—Milton Nelson, Jr.
*Attorney, Agent, or Firm*—Charles A. McClure

[57] ABSTRACT

Lobed resilient lumbar pillow adapted to support the lower back of a person either sitting or reclining against a suitable article of furniture. The pillow has two integrally formed side lobes extending laterally apart from one, and another integral lobe extending upward from the midpart of the top of the pillow. Along its vertical bisector the top lobe surface is preferably recessed notchlike from its edge to accommodate a user's spine. The pillow is filled with resilient contents, such as elastomer, fibers, gas, particulates, or mixtures of two or more thereof, or partly filled with liquid, so as to flex to fit a user's spine.

4 Claims, 2 Drawing Sheets

LOBED LUMBAR PILLOW

TECHNICAL FIELD

This invention relates to a pillow-like article and its use in supporting the lower back of a person sitting upright or reclining.

BACKGROUND OF THE INVENTION

Many structural arrangements are known for supporting the lower (or lumbar) portion of the back of a person sitting upright against a chair back or even resting against an inclined back portion of a less vertically challenging item of furniture. Ribbed or otherwise reinforced articles have been suggested for relieving the stresses that sitting or partial reclining imposes upon the human lower back.

Whatever the comfort or therapeutic value of such structures, they tend to be over-structured in the form of belts, braces, etc. Even if in pillow form they tend to be tailored to specific complex curvatures, which may be fine for some people but not for others.

U.S. utility patents have issued for similarly useful articles, many of them with adjustable structure, such as Curtis 3,765,721; Striano 5,489,260; Gustine 5,544,377; and Leighton 5,551,085.

Similarly, U.S. design patents have issued for generally simpler articles, such as to Sims and Joseph D-282,990; Castronovo D-335,997; Pearl and Lovegrove D-364,065; and Reedus D-368,524.

Notwithstanding the contributions of the mentioned (and other) inventors, there remains a need to enhance overall individualization of lumbar support with uniformity of external design. Our present effort undertakes to provide all persons concerned with such choice.

SUMMARY OF THE INVENTION

A primary object of the present invention is a resilient pad or pillow having a basic design conducive to adequate lumbar support.

Another object of this invention is to provide the basic design with various internal structures selectable for optimal results.

A further object of the invention is to accomplish the various objects economically so as to enable all persons able to be helped by this invention to take advantage of it without undue expense.

In general, the objects of this invention are accomplished by means of a pad or pillow (usually called a "pillow" herein) having a trilobal outline, with an upward central lobe and two flanking side lobes, a cover, and a resilient interior selectable from a range of materials according to desired degree or type of support. The outer edge of the central lobe of the pillow is preferably indented notch-like midway of its edge a short way to provide a transition for the spine of an individual user. The interior of the pillow is filled substantially uniformly but not too tightly with whatever the user may prefer, such as fibers, foam, gas, liquid, or particulates.

Other objects of this invention, together with methods and means for attaining the various objects, will become apparent from the following description and the accompanying diagrams of several embodiments, presented by way of example rather than limitation.

DESCRIPTION OF THE INVENTION

FIGS. 1 to 4 show pillow 20 of the present invention as follows: (i) in perspective, in FIG. 1; (ii) in front view, in FIG. 2; (iii) in plan (top) view, in FIG. 3: and (iv) in right side elevation, in FIG. 4 (the same side at the right of the chair as in FIG. 1).

Figure 1:
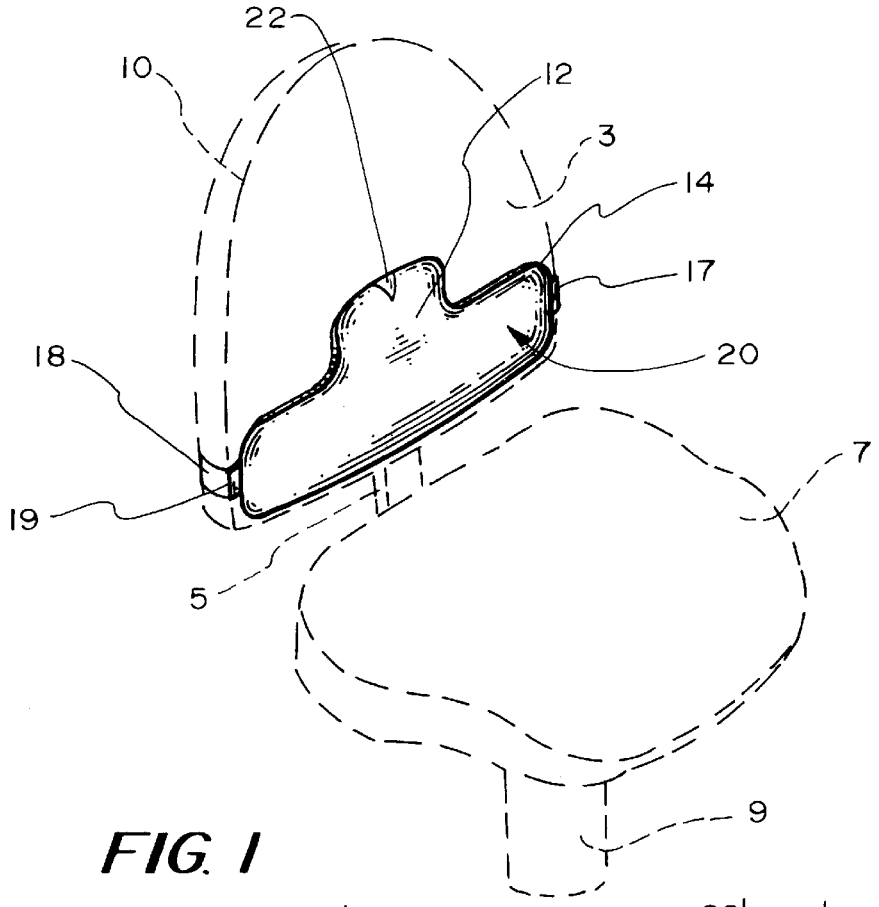
FIG. 1 is a perspective view of a pillow in a use location.

FIG. 1 shows secretarial chair 10 (broken lines) in perspective seen from just above and to the right (viewer's left) of its front. The chair comprises seat 7 on underlying vertical post 9 and upright back 3 on underlying vertical support 5 at the rear of the seat. Pillow 20 is retained in place against the front of the chair back by strap 18 interconnecting left side tab 17 and right side tab 19 of the pillow. Subsequent views show the pillow in more detail.

Figure 2:
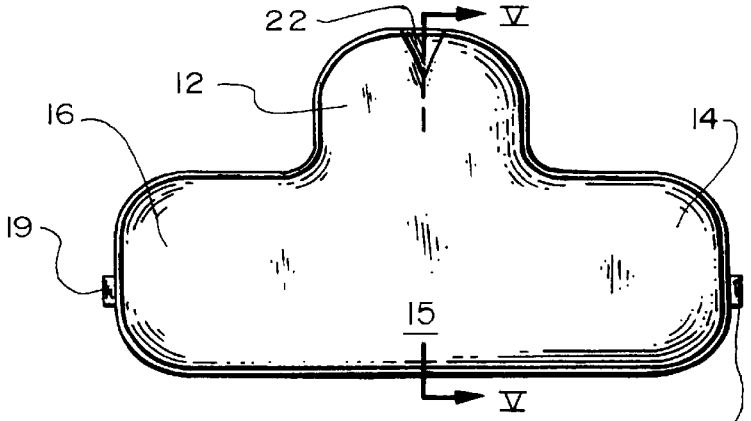
FIG. 2 is a front elevation of the pillow of FIG. 1.

FIG. 2 shows pillow 20, in front elevation, on a larger scale. The pillow clearly comprises a generally rectangular central body portion 15 (so numbered but not separately demarcated) a bit wider than it is high, as distinguished from the lobes making up the rest of the pillow and integrally formed with the body. Extending laterally from the central portion are two lateral lobes: lobe 14 at the pillow's left (viewer's right) side, and lobe 16 at its other or right side. Central lobe 12, centered side-to-side, extends upward from the top edge of the body portion and features notch-like recess or indentation 22 from the top edge partway toward the body portion.

Figure 3:
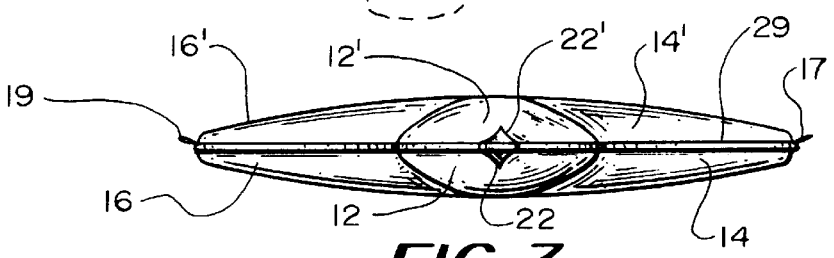
FIG. 3 is a top plan of the pillow of preceding views.
Figure 4:
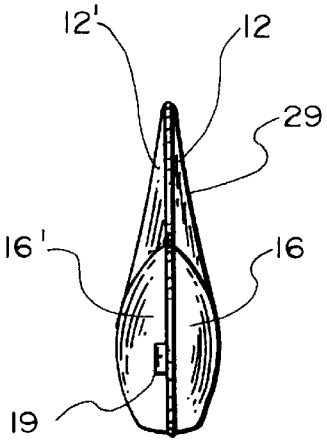
FIG. 4 is a side elevation of the same pillow already shown.

In FIGS. 3 and 4, visible rear parts of the pillow corresponding to front parts have like numbers but with an added prime (').

FIG. 3 shows pillow 20 in top plan, featuring front notch-like recess 22 and matching (as mirror image) rear notch-like recess 22' adjoining each other at top front and rear faces of central lobe 12, 12' in a diamond-like configuration. Although such indentation or recessing need be only in the front lobe face, preferably both faces are so notched as here, whereby either accommodates a user's spine, and the cover can be made more conveniently as two identical halves. Seam 29 (shown here from the top) joins front and rear cover pieces and extends along the entire peripheral edge of the complete pillow.

FIG. 4 shows pillow 20 in right side elevation, featuring more of seam 29, also tab 19 available for interconnection of the pillow to an article of furniture or to a retaining strap therearound. The recessed portions of top lobe 12, 12' are not visible in this view, being concealed by the intervening parts of the lobe.

Figure 5A:
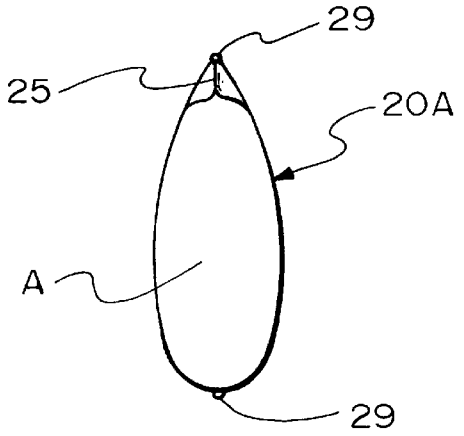
FIGS. 5A, 5B, 5C, 5D, and 5E are sectional elevations through successive embodiments of the pillow of FIGS. 1 to 4, taken at V—V along its medial vertical bisector in FIG. 2, as filled with various materials designated by appropriate shading (or none) in each view.
Figure 5B:
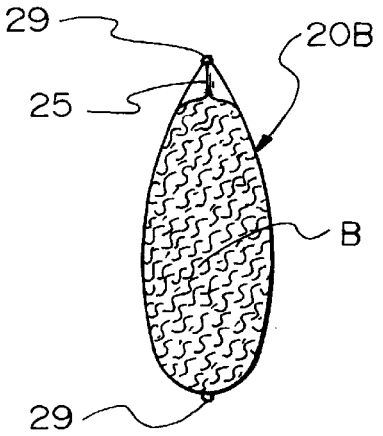
Figure 5C:
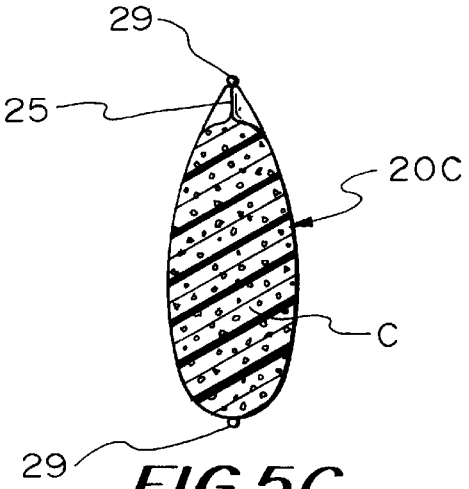
Figure 5D:
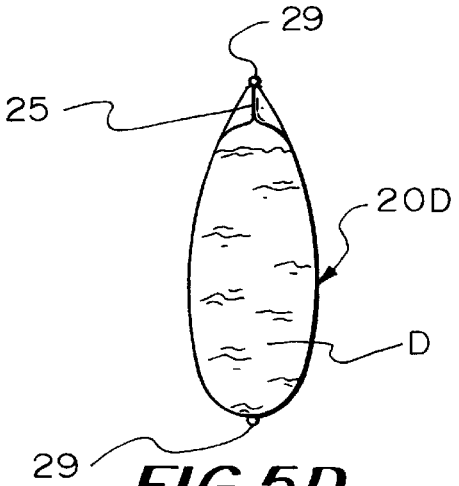

However, those notch-like recessed portions are visible curving out from contiguous web portion 25 in the remaining views, which are vertical sectional elevations taken at V—V on FIG. 2 to show suitable alternative contents of the pillow: FIG. 5A, one or more gases; FIG. 5B, natural or synthetic fibers; FIG. 5C, cellular elastomer; FIG. 5D, liquid; and FIG. 5E, particulates.

The contents are chosen to keep the pillow substantially filled to provide the desired resilience, and are indicated by shading, or by lack of shading as in FIG. 5A, wherein gaseous contents A of pillow 20A will usually be air, itself a mixture of gases. Of course, one of its constituent gases may be used alone, preferably nitrogen.

FIG. 5B shows in outline pillow 20B shaded for fibrous contents B, such as animal feathers, fur, or hair, or natural plant fibers or equivalent synthetic contents (along with air in the interstices), shown here as a profusion of short squiggly line segments therein. Solid contents should be sufficiently resilient to maintain their shape and also not be too susceptible to felt-like packing. Cotton is a suitable natural fiber, and nylon is a suitable synthetic one. Fibrous contents optionally may include loose knit or woven fabrics.

FIG. 5C shows cellular elastomer contents C of pillow 20C as light and heavy parallel shading lines with bubbles interspersed to designate foam cells. Rubber (a terpene hydrocarbon) is a natural elastomer, and many synthetic rubbers are known, such as butadiene-styrene copolymers, butadiene-acrylonitrile copolymers, vinyl chloride/vinyl acetate copolymers, chloroprene polymers, polysulfide polymers, and polysiloxanes. The cells in elastomers of selected resiliency may contain air, carbon dioxide, etc.

In FIG. 5D, liquid contents D of pillow 20D are designated by wave segments. Water is the most likely liquid because of its ready availability and as its leakage is least likely to harm anything. Alternatively, glycerol or a thickened oil or the like may be used. As liquids themselves are not resilient, a pseudo-resilient effect is provided by incompletely filling the pillow, so that the weight of a person against the pillow will mold it into a suitable shape.

Figure 5E:
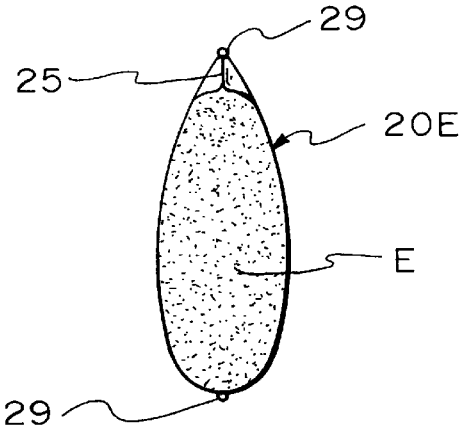

In FIG. 5E, natural or synthetic particulate contents E of pillow 20E appear as dots or short irregular line segments, denoting beads, hulls of grains or nuts, or fragments of whatever origin, with desirable resilience and/or not necessarily filling the pillow.

The pillow cover may be made of suitable flexible impermeable material, such as rubber-impregnated and/or covered fabric or film. It preferably is somewhat stiff so as to tend to to hold its shape, thereby aiding maintenance of the notch (es) recessed in the top lobe to accommodate the user's spine, as in the preferred embodiments. The indentation may be provided by adhering the web of the adjoining faces by heating fusion if composed of an elastomeric plastic film, or by stitching if made of fabric, or by stitching such fabric and then impregnating it with such plastic and heat-treating such web. Both the cover and the contents materials should be non-allergenic.

Part of the peripheral seam, such as along the bottom portion, may be made separable, as by a zipper or hook-and-loop construction, to enable a user to add to, subtract from, or replace the contents.

Although shown on both front and back of the illustrated pillow embodiments, the notch-like recess may be omitted from one face—or even from both faces—if that should be the user's choice, while still retaining the trilobal outline. One-face (only) indentation complicates the pillow construction, necessitating stiffer covering.

The advantages and benefits of the pillow of this invention will be most readily apparent to those who have the opportunity to use such pillow in one or more of its various embodiments.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

The invention claimed:

1. A trilobal two-faced pillow-like article, interposable between a person and a back-supporting portion of an item of furniture, and comprising:

two lobes extending oppositely sidewise, and a third lobe centered sidewise thereof and extending upward therefrom with its outermost facial extent being partially recessed to accommodate a person's spine upon first encountering such face of the third lobe when the article is used as a lumbar support;

the third lobe being so recessed along part of one of its two opposite outer faces, from its outer edge then shallowing to even with its unrecessed surface to transition a person's spine to the full thickness of the pillow.

2. Article according to claim 1, wherein the third lobe is so recessed along such part of both of its opposite outer faces.

3. Article according to claim 1, retained against the back-supporting portion of such item of furniture, with the article's lower edge in place along a component seat thereof, and with its third lobe at the top edge of the article so in place.

4. A two-faced pillow-like article, useful for personal lumbar support, and comprising:

a generally rectangular central portion having a top edge and a bottom edge when in use orientation, and having two side edges;

a pair of lobes adjoining the respective side edges and extending laterally therefrom in opposite directions and in substantial alignment with the respective top and bottom edges;

a single lobe adjoining the top edge at the junctions of the respective side edges thereto and extending upward therefrom;

each of two faces of the single top lobe having a recess therein from its outer edge midpoint across part of its vertical facial extent to accommodate a spine of a person utilizing the pillow-like article as a lumbar support.

* * * * *